US010533399B2

(12) United States Patent
Ceccon De Azevedo et al.

(10) Patent No.: US 10,533,399 B2
(45) Date of Patent: Jan. 14, 2020

(54) MANIFOLD AND SHARED ACTUATOR

(71) Applicant: FMC TECHNOLOGIES DO BRASIL LTDA, Rio de Janeiro (BR)

(72) Inventors: Alex Ceccon De Azevedo, São Goncalo (BR); Leonardo De Araujo Bernardo, Rio de Janeiro (BR); Alan Zaragoza Labes, Rio de Janeiro (BR); Luciano Gomes Martins, Duque de Caxias (BR); Paulo Augusto Couto Filho, Rio de Janeiro (BR)

(73) Assignee: FMC TECHNOLOGIES DO BRASIL LTDA, Rio de Janeiro (BR)

( * ) Notice: Subject to any disclaimer, the term of this patent is extended or adjusted under 35 U.S.C. 154(b) by 38 days.

(21) Appl. No.: 15/741,199

(22) PCT Filed: Oct. 7, 2015

(86) PCT No.: PCT/BR2015/050174
§ 371 (c)(1),
(2) Date: Dec. 29, 2017

(87) PCT Pub. No.: WO2017/000051
PCT Pub. Date: Jan. 5, 2017

(65) Prior Publication Data

US 2018/0187522 A1 Jul. 5, 2018

Related U.S. Application Data

(63) Continuation-in-part of application No. PCT/IB2015/054944, filed on Jul. 1, 2015.

(51) Int. Cl.

| | |
|---|---|
| ***E21B 43/01*** | (2006.01) |
| ***E21B 41/04*** | (2006.01) |
| ***E21B 43/017*** | (2006.01) |

(52) U.S. Cl.
CPC ..... *E21B 43/0107* (2013.01); *E21B 41/04* (2013.01); *E21B 43/017* (2013.01)

(58) Field of Classification Search
CPC .... E21B 41/04; E21B 41/0007; E21B 43/017; E21B 43/0107; F16K 31/46
(Continued)

(56) References Cited

U.S. PATENT DOCUMENTS 3,504,741 A * 4/1970 Talley, Jr. ..... E21B 43/017 166/267
3,777,812 A 12/1973 Burkhardt et al.
(Continued)

FOREIGN PATENT DOCUMENTS

| | | |
|---|---|---|
| EP | 1070573 A1 | 1/2001 |
| GB | 2284839 A | 6/1995 |
| WO | 00/52370 A1 | 9/2000 |

OTHER PUBLICATIONS

International Search Report of the International Searching Authority issued in PCT/BR2015/050174 dated May 13, 2016 (2 pages).
(Continued)

*Primary Examiner* — Michael R Reid
(74) *Attorney, Agent, or Firm* — Osha Liang LLP

(57) ABSTRACT

A system includes a manifold and a shared valve actuation system that is operatively coupled to the manifold at a single location. The manifold is comprised of a block with at least one drilled header hole formed within the block, a plurality of drilled flow inlet holes formed within the block, wherein the number of drilled flow inlet holes corresponds to the number of external flow lines that supply fluid to the manifold, and a plurality of isolation valves coupled to the block, the valve element for each of the isolation valves positioned within the block. The system includes an arm that rotates about an axis that is normal to an upper surface of the block of the manifold, a plurality of structural elements that
(Continued)

are coupled to one another via rotary joints, and a tool that engages and actuates one of the plurality of isolation valves.

18 Claims, 13 Drawing Sheets

(58) Field of Classification Search
USPC ..... 166/338
See application file for complete search history.

(56) References Cited

U.S. PATENT DOCUMENTS

| | | | | |
|---|---|---|---|---|
| 3,897,805 | A * | 8/1975 | Casey | E02F 3/76 137/636.2 |
| 3,957,079 | A | 5/1976 | Whiteman | |
| 4,625,805 | A | 12/1986 | Ladecky | |
| 6,644,410 | B1 | 11/2003 | Lindsey-Curran et al. | |
| 2008/0109108 | A1 | 5/2008 | Lawson | |
| 2009/0050328 | A1 | 2/2009 | Bath et al. | |
| 2010/0042357 | A1 | 2/2010 | McCoy, Jr. et al. | |

OTHER PUBLICATIONS

Written Opinion of the International Searching Authority issued in PCT/BR2015/050174 dated May 13, 2016 (6 pages).

* cited by examiner

MANIFOLD AND SHARED ACTUATOR

CROSS-REFERENCE TO RELATED APPLICATIONS

This application is a U.S. National Stage Entry application of International Application No. PCT/BR2015/050174, filed Oct. 7, 2015, which claims priority to International Application No. PCT/IB2015/054994 filed on Jul. 1, 2015, both, of which are incorporated by reference in their entireties.

FIELD OF INVENTION

The present invention relates to a manifold with unique block architecture and a shared actuator system that is designed to control the flow of fluids from various flow lines, which, for example, may be the flow of oil/gas from oil wells and to wells if the manifold is configured for injection.

BACKGROUND OF THE INVENTION

A traditional subsea manifold is a device that is designed to control the flow of fluids from oil wells and direct the flow through various production/injection loops that are made of piping, valves, connector hubs and fittings. A traditional subsea manifold also typically includes various flow meters and controls systems for monitoring the flow of the fluids and controlling various valves. The most common joining method for the piping, valves, hubs and fittings is by welding but bolted flange connections are also used.

The manifolds can be classified into: production (oil, gas or condensate), water injection, lift and mixed (production and water injection). They all have a similar basic structure. A typical subsea manifold has a main base which is a metal structure that supports all piping, hydraulic and electrical lines, production and crossover modules, import and export hubs and control modules of the subsea manifold.

Typically, to design a subsea manifold certain information is needed: a flowchart of fluid flow, the number of Christmas (wells) trees that will be linked, and possibly other platforms manifolds. In general, the flowchart of fluid flow is provided by the client. With the requirements of the system, it is possible to begin the process of designing the elaborate arrangement of pipes, valves and hubs that will be part of the subsea manifold. A typical subsea manifold also includes an arrangement of structural members, e.g., a support structure comprised of beams and cross members that are designed to facilitate the installation of the manifold, distribute external loading and also support the arrangement of pipes and other equipment or components of the subsea manifold.

Below is one example of a summary of the steps for preparing the design of the conventional subsea manifold.

1. Flowchart.
2. Prepare the design of the arrangement of pipes, valves and hubs.
3. Prepare the design of the metal support structure.

The conventional subsea manifold promotes the flow of fluid from the oil and gas wells in manner mandated by the fluid flowchart of the project, through a complex arrangement of numerous flow paths that are defined by welded pipes, pipe fittings, such as elbows and/or flanged connections. Valves are positioned within the pipe flow paths to control the flow of fluid and there is a requirement to open and close these valves at various times.

FIG. 1*a* is an example of a traditional subsea manifold 20, while FIG. 1*b* is view of the subsea manifold 20 with various structural members omitted so as to better show the various flow lines, valves and manifolds that are part of a typical subsea manifold 20. As shown in FIG. 1*a*, the subsea manifold 20 is comprised of a main base 20*a* and arrangement of structural members 20*b*. As noted above, the combination of the main base 20*a* and arrangement of structural members 20*b* are designed to support the arrangement of the pipes and other equipment or components of the subsea manifold 20. More specifically, the external structure of the manifold provides a space frame that is used for a variety of purposes: 1) to facilitate the lifting and installation of the manifold 2) to protect the valves and pressure piping from dropped objects, 3) to provide structural support for the connection piping between the tree—manifold and the manifold—export piping and 4) to support piping loads whether induced by weight, thermal or vibration, i.e., to absorb substantially all piping loads. With reference to FIG. 1*b*, the illustrative subsea manifold 20 is designed for receiving fluid from 4 oil wells and it has two headers 21 that are adapted to be coupled to two flow lines. More specifically, the subsea manifold 20 is comprised of four vertically oriented connections 20*c* (where flow from each of the oil wells will be received) and four vertically oriented hubs 20*d* on the headers 21 (for providing input and output connections to two flow lines (not shown) that provide fluid to/from the manifold 20). The manifold 20 also includes eight illustrative inlet flow valves 20*d* (that direct the flow of fluid received from the wells) and two illustrative header valves 20*e* to control the flow of fluid within the headers 21. The eight inlet flow valves are positioned in four separate valve bodies 20*f* (valve blocks are sometimes used in lieu of valve bodies), ten illustrative valves/valve actuators and various piping arrangements and loops 20*g* comprised of welded pipe sections, fittings and flanges. Additionally, from time to time, various operations are performed to clean out the interior of the various piping loops. e.g., a full diameter pig is forced through the piping system. A pig can also be used for inspection of the pipe and other maintenance and inspection operations. Accordingly, the pipe loops and elbows must be sized large enough such that such pigging devices may readily pass through all of the "turns" within the piping system, i.e., the turns within the piping system must have a large enough radius so as to insure that such cleaning devices may readily pass through the turn in the piping system.

In the depicted example, ignoring the main base 20*a* and arrangement of structural members 20*b*, the subsea manifold 20 is comprised of twenty four connections, eighteen spool pieces, which require fifty welding processes, six separate valve blocks and eight hubs 20*c*, 20*d*. The key point is that, irrespective of exact numbers (which will change depending upon each application), a typical or traditional manifold requires numerous individual components, and it requires that numerous welding procedures and inspection procedures be performed to manufacture such a traditional manifold. In the depicted example, the subsea manifold 20, including the main base 20*a* and arrangement of structural members 20*b*, has an overall weight of about 90 tons—about 33 tons of which are comprised of pressure retaining pipe and equipment and about 57 tons of which are comprised of various structural members 20*b* and the main base 20*a*. More specifically, a typical prior art subsea manifold may have an overall length of about 8 meters, an overall width of about 7 meters and an overall height of about 7 meters. Thus, in this example, the traditional subsea manifold 20 has a "footprint" of about 56 $m^2$ on the sea floor and occupies about 392 $m^3$ of space. Of course, these dimensions are but examples as the size and weight of such subsea manifolds 20 may vary depending upon the particular application. But the point is, traditional subsea manifolds 20 are very large and heavy and represent a complex arrangement of piping bends and valves to direct the flow of fluid received from the wells as required for the particular project.

The above noted problems with respect to the weight and dimensions of traditional subsea manifolds 20 is only expected in increase in the future due to the increasing number of valves along with Increases in working pressure and subsea depth, resulting in increased weight and dimensions for future subsea manifolds 20. In short, a traditional subsea manifold 20 is a structure that has a large size and weight that is comprised of many parts: pipes, bends, fittings, and hubs, and involves performing numerous welding operations to fabricate, all of which hinder the process of fabrication, transportation and installation. Installation of a subsea manifold is a very expensive and complex task. The manifold must be lifted and installed using cranes designed for the dynamic conditions created by wave, wind and current conditions offshore. The weight of the manifold combined with the dynamic sea conditions requires large installation vessels that are very expensive to operate. Lifting a manifold typically will require an offshore crane with a lifting capacity that is 2× or 2.5× the weight of the manifold due to the dynamic loading and dynamic amplification that results from motion induced by the sea conditions.

In terms of controlling the operations of subsea manifolds, i.e. the opening and closing of various valves, there are several known actuation means employed to actuate the subsea valves used in subsea manifold systems. One system approach relies on manual valves. With a manual valve equipped manifold, valves are operated by divers (in shallow water applications) or a Remotely Operated Vehicle (ROV) (in deep water applications). A drawback manual valve system is the need to deploy a diver to operate manual valves for shallow water manifolds and deploy an ROV for valve operations when required in a manifold installed in deep water. Another valve actuation method relies on direct connection of hydraulic fluid from the surface to the manifold valve actuator—a direct hydraulics actuation system. One drawback of a direct hydraulic actuation system is the distance between the manifold and the hydraulic supply on the surface. This limitation makes a direct hydraulics actuation system unsuited for deep water or long distance "step-outs". Another example comprises the use of general hydraulic actuators controlled by an electro-hydraulic Subsea Control Module (SCM). Typically, such a control system consists of an undersea control module (SCM) comprised of an electrical control module used to selectively direct fluid via a series of directional control valves to the manifold valve actuator which is desired to be opened or closed through pipe connected between the actuators and the undersea control module. A compensation system composed of pipe connected to a variable volume chamber is required to receive and discharge fluid that is displace during valve opening or closing. The hydraulic fluid used to power the actuator must be delivered to the control system via an umbilical connecting the hydraulic fluid supply from the surface to the undersea control module. The electrical power and signals to the subsea control module (SCM) can be achieved via dedicated and separate electrical umbilical and hydraulic umbilical or alternately the electrical power and signal transmission wiring can be bundled together with the hydraulic fluid transmission piping within a bundled electric—hydraulic umbilical. The electrical power and signal are transmitted from surface power and signal units through the power, signal and hydraulic umbilical to the undersea control module.

One drawback encountered in this technique is the weight and dimensions of the traditional subsea hydraulic valve actuation system, and this problem is only expected to be more problematic in the future with future subsea manifolds having an increased number of valves along with an increase in the working pressure and the operational subsea depth, all of which result in an increase of weight and size of traditional subsea hydraulic valve actuation systems. Another drawback of this system is the number and/or size of electrical and hydraulic umbilicals and the associated seabed installation costs. Yet another drawback of this technique is the extensive time required for piping installation of electro-hydraulic control system between the SCM and manifold valves—which implies an increase in the time it takes to manufacture the manifolds, plus the associated cost with the necessary equipment such as hydraulic actuators, the subsea control module, the electro-hydraulic umbilical and hydraulic power unit.

An alternative to the technique described above, but less frequently used nowadays, is the use of undersea electric actuators. According to this technique, each manifold valve to be remotely controlled has an electric actuator mounted to the manifold valve and is connected to an electrical control system. The electrical control system consists of a power grid in the manifold to supply power and signals to the actuators connected to an umbilical with electrical leads connecting the undersea system to an electric power unit and control unit located on the surface.

An advantage presented by this second technique is the reduction in time required to manufacture the manifold, since the installation of the hydraulic control system in the manifold is not necessary. However, in spite of reducing the system cost by eliminating the cost of the hydraulic umbilical, the surface power unit and the undersea control module, the use of electric valve actuators makes this system much more expensive than the first one, since such electric valve actuators are expensive items of equipment in the market.

Another known alternative consists of a shared actuation system (SAC). Such a shared actuation system consists of the use of a structure located along one side of the manifold with an actuation tool that is displaced by a mechanism to the interface of each valve at the time of their actuation. In this alternative, the manifold contains only manual valves without remote actuation, and the actuation of any manifold valve is accomplished by use of the SAC. The mechanism, which displaces or moves the actuation tool to a desired location above a valve to be actuated, does it through a Cartesian coordinate positioning system that is moved by hydraulic pistons on rails and operated by an electro-hydraulic control system. The position of the actuation tool is checked by position and flow sensors located in the SAC. The actuation tool consists of a device that enables the interface with the valve stem and applies torque through a hydraulic power system. The number of turns applied is verified through the flow-through in the tool. Typically, the electro-hydraulic control system comprises a hydraulic pipe connected to the SAC, an undersea electro-hydraulic control module, a SAC compensation system, an umbilical containing hoses and electrical leads to supply fluid, electrical power and signals, connected to the hydraulic pressure unit on the surface and the electrical and control power unit also located on the surface. The SAC can be installed separately and removed from the manifold for repair if necessary. As it is known by those skilled in the art, this third alternative was used only once in the industry for remote actuation of valves.

A shared actuation system (SAC) may be employed in an attempt to minimize the drawbacks of the techniques described above. However, the costs of the undersea control module, hydraulic umbilical and surface hydraulic power unit are still present. Another drawback presented by the use of ashared actuation system (SAC) consists of the constructive characteristic of the Cartesian positioning of the system, which requires that the equipment has the same dimensions as the plane where the valves are contained. Such a requirement makes the equipment heavy and difficult to be installed and removed in case of failure or maintenance. In addition, the large size of the equipment compromises the integration of shared actuation system with the manifold, making it complex and difficult or almost impossible to promote interchangeability.

Other control systems of undersea devices are described in the prior art. Patent application US 2010042357 discloses a system and method for determining the position of an articulated member relative to a plane, and said system may be adapted for undersea use. Patent application US 2008109108 discloses a control system for a manipulator arm for use in undersea remotely operated vehicles (ROVs). U.S. Pat. No. 6,644,410 discloses a modular control system composed of independent segments for use in undersea equipment, including manifolds. Patent application US 2009050328 discloses a system for undersea installation of insulation on flowlines, connectors and other undersea equipment from a remotely operated vehicle. Patent application EP 1070573 describes a system for the application and monitoring of undersea installations, such as manifolds valves. However, none of the abovementioned documents discloses the subject matter of the present invention, which advantageously solves the drawbacks of the remote actuation systems of undersea valves described by the prior art to date, namely, excess weight and large size of the system, high costs, long manufacture period, and restrictions on the repair and replacement of parts and the equipment itself.

The present application is directed to an improved manifold with a unique block architecture and shared actuator system that may eliminate or at least minimize some of the problems noted above with respect to traditional subsea manifolds.

BRIEF DESCRIPTION OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

Disclosed herein is an illustrative system for receiving fluid flow from a plurality of external flow lines, wherein each of the external flow lines is connected to a respective one of a plurality of sources of fluid to be provided to the system. In one illustrative embodiment, the system comprises a manifold and a shared valve actuation system that is operatively coupled the manifold at a single location. In this example, the manifold is comprised of a block with at least one drilled header hole formed within the block, a plurality of drilled flow inlet holes formed within the block, wherein the number of drilled flow inlet holes corresponds to the number of the plurality external flow lines, and wherein the drilled flow inlet holes are in fluid communication with the at least one header via at least one other drilled hole formed within in the block, and a plurality of isolation valves coupled to the block wherein the valve element for each of the isolation valves is positioned within the block. In the example depicted herein, the shared valve actuation system comprises an arm that is adapted to rotate about an axis that is normal to an upper surface of the block of the manifold, a plurality of structural elements that are coupled to one another via rotary joints and a tool that is adapted to engage and actuate one of the plurality of isolation valves.

BRIEF DESCRIPTION OF THE DRAWINGS

The present invention will be described with the described drawings, which represent a schematic but not limiting its scope.

Figure 1A:
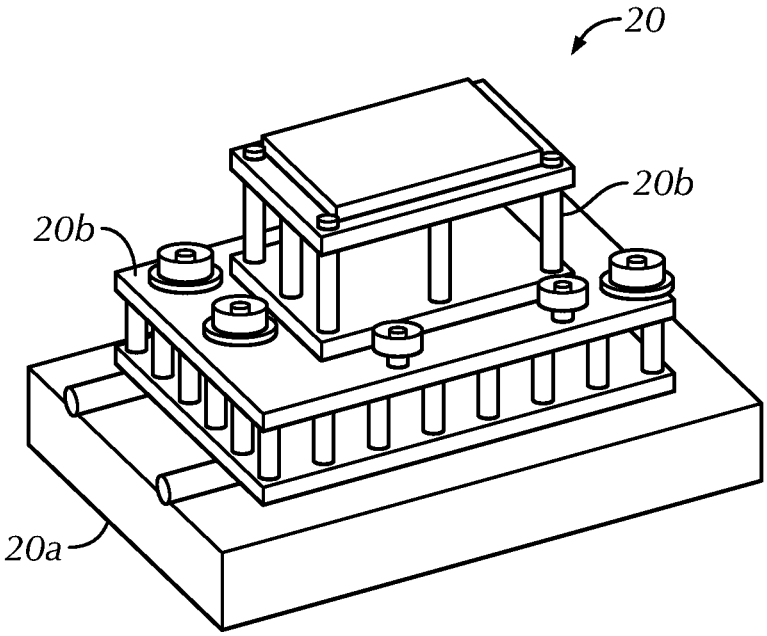
FIG. 1A (Prior Art)
FIGS. 1(*a*)-(*b*) depict one illustrative example of a traditional subsea manifold according to the prior art.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Various illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 5:
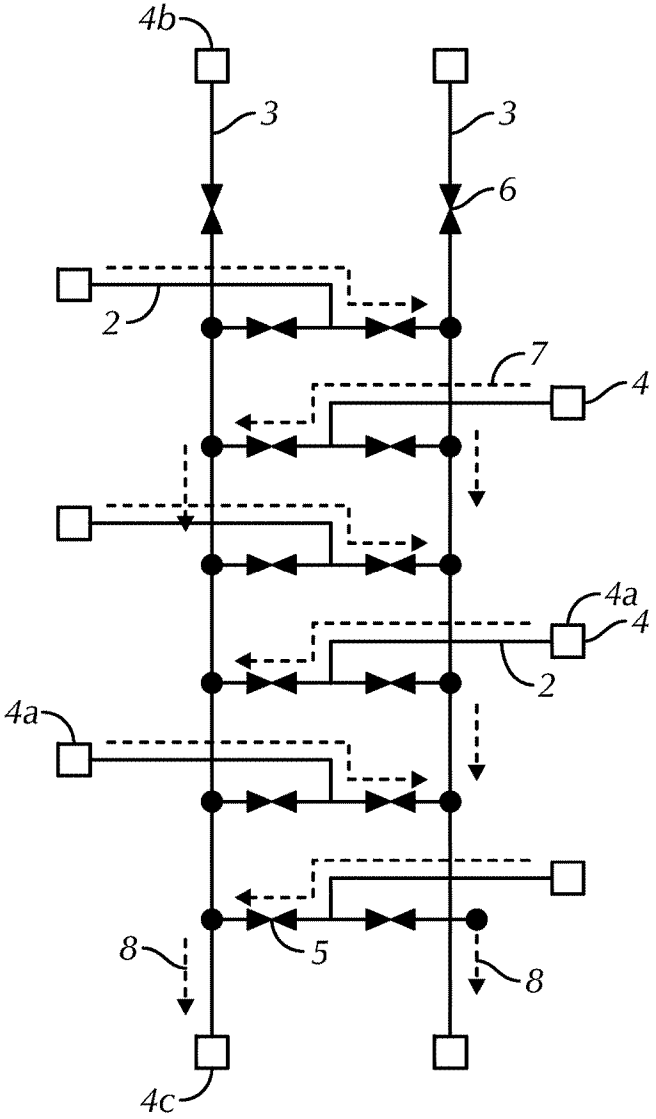
FIG. 5 is a flowchart that schematically shows the parts of one illustrative example of a unique block architecture for a manifold as disclosed herein that is designed for 6 wells.
Figure 5A:
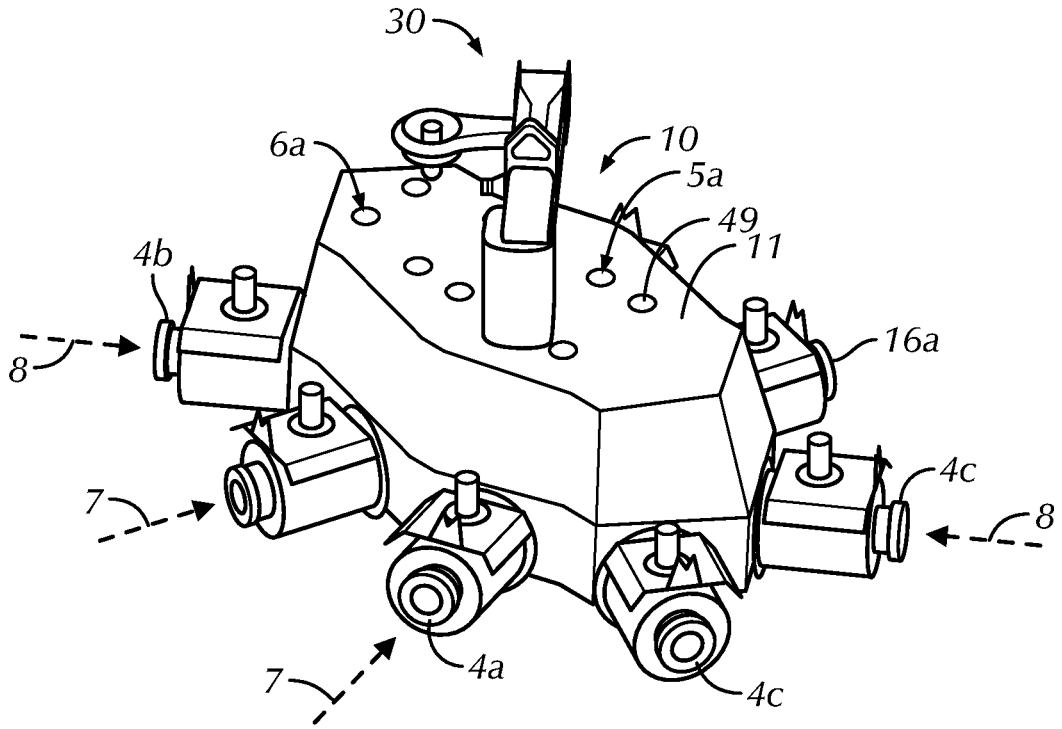
FIG. 5A is a perspective view of one illustrative embodiment of a manifold system disclosed herein.
Figure 5B:
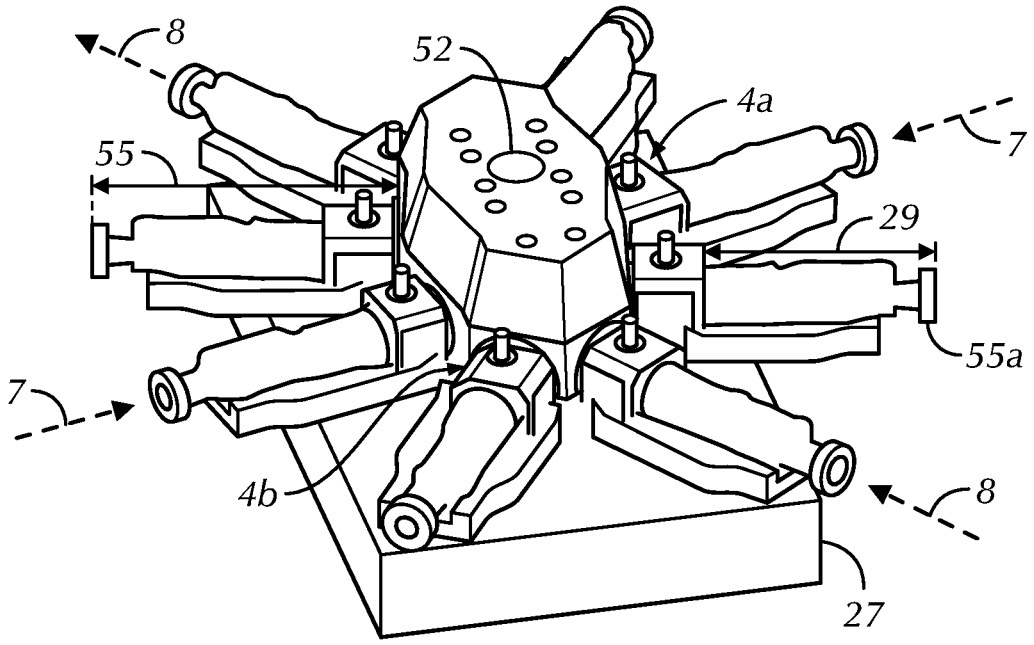
FIG. 5B is another perspective view showing various aspects of one illustrative embodiment of a manifold system disclosed herein.

According to the figures, it is observed that the manifold system (10) disclosed herein comprises a block (1) that is positioned on a base 27 (see FIG. 5B). In the depicted example, the manifold system generally includes a block 1, a plurality of hubs 4 (flow inlet hubs 4*a*, header inlet hubs 4*b* and header outlet hubs 4*c*), a plurality of isolation valves 5, 6, a cover 11 and a shared valve actuator system 30 that is adapted to actuate the valves 5, 6 as need. As described more fully below, the shared valve actuator 30 is coupled to the manifold via a single rotary connection. However, the shared valve actuator system 30 may not be employed in all applications, i.e., in some cases the isolation valves 5,6 may be actuated by other means, such as an ROV, or each may be provided with their own individual actuator. Of course, depending upon the particular application and any customer specific requirements, the number of isolation valves may vary in one or more of the lines. For example, instead of two flow isolation valves to direct the flow of a fluid received in a particular line, a third isolation valve may be provided in the network so as to provide an additional pressure barrier during well operations. Thus, the particular number of valves and their particular placements depicted herein are but examples and should not be considered to be a limitation of the presently disclosed inventions.

Figure 4:
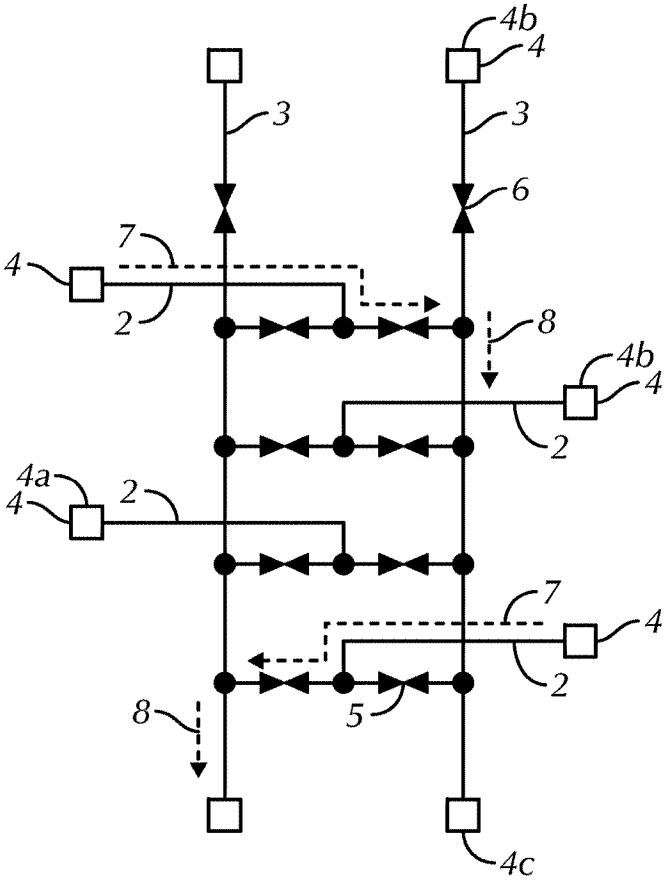
FIG. 4 is a flowchart that schematically shows the parts of one illustrative example of a unique block architecture for a manifold as disclosed herein that is designed for 4 wells.

The block 1 is provided with drilled or machined holes "wells lines" (2) wherein the number of inlet holes (2) corresponds to the number of wells and/or desired manifolds that provide fluid flow to the manifold (10) via various flow lines (not shown). The holes (2) are responsible for the fluid flow (7) (shown schematically in FIGS. 4 and 5) that comes from the wells (originating from the Christmas trees) and/or other manifolds to the manifold (10) via flow inlet hubs 4*a*. The block 1 is also provided with drilled or machined holes "called headers" (3) that are responsible for directing the flow (8) of fluid to and from the manifold (10) via flow lines (not shown) that are coupled to the header inlet hubs 4*b* and header outlet hubs 4*c* thereby providing the connection between the manifold (10) and other manifolds or components. The illustrative manifold (10) depicted in FIGS. 6, 6A, 7-7B and 8 also includes eightwell flow (inlet fluid) isolation valves (5) and two header flow isolation valves (6) (positioned in line with the headers (3)). The isolation valves (5), (6) may be actuated to open or close a flow line, and they may be used to control and selection of the flow lines within the block 1 that will be used in operation to direct the flow of fluids within the block 1 as required. Two of the well flow isolating valves (5) are used to control the direction and routing of the fluid received from a well (via a particular inlet hole 2) within the block 1. That is, by opening one of the well flow isolation valves (5) and closing the other well flow isolation valves (5) associated with a particular inlet hole 2, the direction of the flow that comes from the wells may be directed as desired within the block 1. The header isolation valves (6) may be used to block, allow or throttle flow within the headers 3. The manifold (10) is provided with a cover (protection) (11) fastened to the hubs (4) and valves (5) and (6).

The block 1 also comprises a plurality of machined holes or intersections (9) (crossover lines) that may be used to route fluid from the inlet holes (2) to the headers (3) via the actuation of one or more of the valves (5). That is, the machined/drilled holes (2) and (3) in the block (1) in combination with the intersections (9) constitute a network of machined/drilled holes that provide for the routing of the fluid stream within the block 1. Thus, the flow of the fluids originating in production wells will go through the holes (2), the intersections (9) and holes (3). This characteristic is extremely relevant to the manifold (10) disclosed herein. That is, by forming this network of machined holes within the block 1, the need for the design and manufacture of piping (see 20*g* in FIG. 1*b*) and most if not all of the metal supporting structure (20*b*) and the welding of the pipe elements (20*g*) commonly used/performed in a conventional manifold may be omitted.

Illustrative Embodiment for 4 Wells

From FIGS. 2, 3, 4 and 6 shows the architecture of a block 1 according to one illustrative embodiment disclosed herein.

In this particular example, the block (1) is provided with four holes "called wells lines" (2). The holes (2) are responsible for receiving the flow of fluid (7) that comes from wells (originating from the Christmas trees) and/or another manifold. The block 1 is also comprised of two holes "called headers" (3) that are responsible for directing the flow (8) of fluid to and from the manifold (10) via flow lines (not shown) that are coupled to the header inlet hubs 4*b* and the header outlet hubs 4*c* thereby providing the connection between the manifold (10) and other subsea manifolds or components. The manifold (10) also includes eight well flow (fluid inlet)isolation valves (5) and two header isolation valves (6) that carry out opening or closing a flow line, being responsible for flow control and selection of the flow lines which will be used in operation. As noted above, two of the well flow isolating valves (5) working one open and the other closed, may be operated so as to select the direction of the flow that comes from the well takes once it enters the block 1. The header isolation valves (6) may be used to block, allow or throttle flow within the headers 3. As before, in this example, the manifold (10) is equipped with one cover (11) fastened to the block with eight hubs (4) (flow inlet hubs 4*a*, header inlet hubs 4*b*; header outlet hubs 4*c*) and eight well inlet flow valves (5) (12 valves should the customer adopt the 3 valve per branch isolation philosophy) and two header valves (6).

In this particular example the block 1 also comprises four intersections (9) (crossover lines) that may be used to route fluid entering the holes (2) to the headers (3) via the actuation of one or more of the valves (5). Thus, the flow of the fluids originating in production wells will go through the holes (2), the intersections (9) and header holes (3).

Illustrative Embodiment for 6 Wells

FIG. 5 schematic depicts a block 1 according to another illustrative embodiment disclosed herein. In this particular example, the block (1) is provided with six holes "called flow lines" (2). The holes (2) are responsible for receiving the flow of fluid (7) that comes from wells (originating from the Christmas trees) and/or other manifolds. The block 1 is also comprised of two holes "called headers" (3), responsible for directing the flow (8) of fluid to and from the manifold (10) via flow lines (not shown) that are coupled to the header inlet hubs 4*b* and the header outlet hubs 4*c* thereby providing the connection between the manifold (10) and other manifolds or components. The manifold (10) also includes twelve well flow isolation valves (5) and two header isolation valves (6) that carry out opening or closing a flow line, being responsible flow control and selection of the flow lines which will be used in operation. As noted above, two of the well flow isolating valves (5) working one open and the other closed, may be operated so as to select the direction of the flow that comes from the well takes once it enters the block 1. As before, the header isolation valves (6) may be used to block, allow or throttle flow within the headers 3. The manifold (10) is also equipped with one cover (11) fastened to the block with ten hubs (4) (six flow inlet hubs 4*a*, two header inlet hubs 4*b*; and two header outlet hubs 4*c*), twelve well flow isolation valves (5) (sixteen should the customer adopt the 3 valve per branch philosophy) and two header isolation valves (6).

In this particular example the block 1 also comprises six intersections (9) (crossover lines) that may be used to route fluid from the holes (2) to the headers (3) via the actuation of one or more of the valves (5). Thus, the flow of the fluids originating in production wells will go through the holes (2), the intersections (9) and header holes (3).

Of course, as will be appreciated by those skilled in the art after a complete reading of the present application, the novel manifold comprises provides a very flexible approach that may be extended beyond the illustrative examples depicted herein without departing from the scope of the inventions disclosed herein, For example, in some applications, it may be required to design a manifold that accommodates more than six Christmas trees (wells) connected to the manifold 10. In such instances, it is envisioned that multiple blocks 1 will be required to accommodate all of the isolation valves 5 (and/or valves 6). More specifically, in one example it is contemplated that multiple blocks (e.g., multiple versions of the block 1*a*) may be connected together to accommodate all of the isolation valves in the manifold 10. Such multiple blocks 1*a* may be operatively coupled together using any of a variety of fastening mechanisms, e.g., such as bolts or other means securing one block 1*a* to an adjacent block 1*a*. Of course, the illustrative caps 1*b*. 1*c* may or may not be employed in such an application. In the case where multiple blocks (like the blocks 1*a* are employed) the headers 3 will be aligned to insure unobstructed flow of fluid or pigs. etc. through the combined assembly of the blocks 1*a*. A seal will be provided between the block 1*a* to insure pressure tight integrity between the interfaces between the blocks 1*a* at each header 3.

Effects and Benefits

As will be appreciated by those skilled in the art after a complete reading of the present application, the novel manifold comprises all of the isolation valves need to control fluid flow within for the manifold are positioned in the block 1, i.e., the valve element for each of the isolation valves is positioned within that block. The block also includes a network of drilled or machined holes 2, 3 within block. The isolation valves 5 may be selectively actuated so as to control and direct the flow of fluid from oil wells within the block 1 to the headers 3. These characteristics, above described, give the novel manifold disclosed herein at least some of the following advantages relative to traditional subsea manifolds:

1. the manufacture of the manifold disclosed herein is faster and simpler;
2. the manifold disclosed herein has a reduced overall weight and size;
3. simplifies and reduces the logistics and transportation of the manifold;
4. reduces numbers of parts of the manifold (e.g., connections, spool pieces, pipes);
5. reduces the need for welding:
6. promotes standardization of the production line of the manifold.

The following is a table making a simple comparison of one embodiment of the manifold disclosed herein relative to a conventional subsea manifold (Table 1):

| | | Conventional Design | New Design |
|---|---|---|---|
| Hubs for 4 wells | Connections | 24 | 0 |
| 4 hubs | Spools | 18 | 0 |
| 10 valves | Welding | 50 | 0 |
| | Valves blocks | 6 | 2 |
| | Hubs | 8 | 8 |
| | Weight | 57 tons | 25 tons |

As noted above, the manifold disclosed herein substantially reduces the complexity of production, assembly, transport, installation and operation of a manifold. The manifold disclosed herein may be produced in any material as is appropriate for the application. The material should be resistant to temperature, pressure and corrosive environment, when dedicated to subsea applications.

With continuing reference to the drawings, in the depicted example, the number and the diameter of the holes 2 and 3 and the intersections 9 (crossovers) may vary depending upon the particular applications. In the illustrative example depicted herein, the manifold 10 is comprised of two headers 3. However, in some applications, the manifold 10 may contain only a single header 3, or it may contain several headers 3 (e.g., the manifold 10 may contain three headers 3 wherein one of the headers is used for well testing). Thus, the number of headers 3 and openings 2 should not be considered to be a limitation of the presently disclosed inventions. Typically, the headers 3 may have a larger diameter than the holes 2, and/or intersections 9, although such a configuration may not be required in all applications. In one particular example, the headers 3 may have a diameter of about 250 mm, while the holes 2 and intersections 9 may have a diameter of about 130 mm. However, in other applications, the headers 3 and holes 2 may have the same diameter.

The isolations valves 5, 6 disclosed herein may be any type of valve, e.g., a gate valve, a ball valve. etc. that is useful for controlling the fluid flow as described herein. The valves 5, 6 are mounted to the block 1 by a flanged connection, and they are mounted such that their valve element, e.g., a gate or a ball, is positioned within the block 1. In the depicted example, the valves 5, 6 do not have their own individual actuators, i.e., they are mechanically actuated valves that may, in one embodiment, be actuated by the shared valve actuator 30 as described more fully below. However, as noted above, the shared valve actuator system 30 may not be employed in all applications, i.e., in some cases the isolation valves 5, 6 may be actuated by other means, such as an ROV, or each of the valves 5, 6 may be provided with their own individual actuator (hydraulic or electric) while still achieving significant benefits via use of the unique block architecture disclosed herein.

With reference to FIGS. 6, 6A, 7, and 7A, in the depicted example, the block 1 is comprised of a three components: a generally rectangular shaped body 1*a*, an inlet end cap 1*b* and an outlet end cap 1*c*. The end caps 1*b*, 1*c* may be coupled to the body 1*a* by a plurality of bolts but other fastening methods are possible i.e. a clamp. The body 1*a* is a continuous block of material (i.e., a steel forging) that has all of the holed 2, 3, 9 drilled or machined into the block of material. FIG. 7B is a perspective view of one illustrative example of the body portion 1*a* of the block 1. As shown, the holes 2, 3 are drilled in the body 1*a* along with holes 5*a* for receiving the valve element (not shown) of the isolation valves 5. In terms of manufacturing the block 1, in some cases, openings 13*a* (see FIG. 7B) may be formed in the body portion 1*a* of the block 1 so as to facilitate machining of the various holes 2, 3, and 9 or a part of forming the holes themselves. Some of these openings 13*a* may eventually be blinded with a metal blind 13 in the final manifold (see FIGS. 2, 3, 6 and 7). The end caps 1*b*, 1*c* may be bolted to the ends 1*y*, 1*z*, respectively, of the body portion 1*a* of the block 1. In the depicted example, the end caps 1*b*, 1*c* are provided with angled outer surfaces 1*x* (see FIGS. 6 and 6A) that are angled with respect to the centerline of the header holes 3 that extend through the body portion 1*a* of the block 1. However, it is possible that the holes will not be angled in every configuration. For example a single header design will not require the holes to be angled. FIGS. 7C and 7D are top and side views, respectively, of an embodiment of the block 1 that comprised twelve isolation valves 5. As depicted a plurality of holes 5*a* and 6*a* are formed in the block 1 for the valves 5, 6. Also depicted in these two drawings are one example of the routing of the drilled holes 2, 3 and 9 within the block 1 as well as several of the openings 13*a* that may be subsequently blinded. Additionally, in some applications the end caps 1*b*, 1*c* may be omitted and the block may be a single block of material with the drilled header holes 3 and the plurality of drilled flow inlet holes 2 formed within the single block of material.

In the example depicted herein, all of the well flow (inlet flow) isolation valves 5 are positioned within the body portion 1*a* of the block 1, while the header isolation valves 6 are positioned within the inlet end cap 1*b*. Importantly, unlike prior art subsea manifolds, all of the isolation valves associated with controlling the flow of fluid to and through the manifold 10 are positioned within a single block 1 (the combination of portions 1*a-c*), along with the network of drilled (machined openings (2, 3, 9) where fluid may flow within the block 1. The isolations valves 5, 6 disclosed herein may be any type of valve, e.g., a gate valve, a ball valve, etc. that is useful for controlling the fluid flow as described herein. In the depicted example, the valves 5, 6 do not have their own individual actuators, i.e., they are mechanically actuated valves that may, in one embodiment, be actuated by the shared valve actuator 30 as described more fully below. However, the shared valve actuator system 30 may not be employed in all applications. i.e., in some cases the isolation valves 5, 6 may be actuated by other means, such as an ROV, or each may be provided with their own individual actuator. In one example, the block 1 (the combination of portions 1*a-c*) disclosed herein has an overall length of about 2.5 meters, an overall width of about 1.5 meters and an overall height of about 1 meter.

Figure 2:
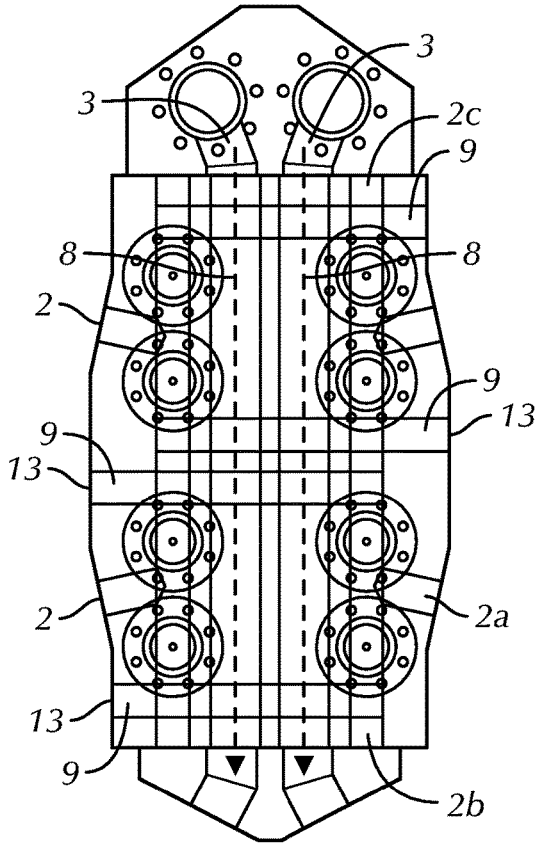
FIG. 2 is an illustrative internal view of one illustrative example of a unique block architecture for a manifold as disclosed herein that is designed for 4 wells, wells lines, headers and flow lines in the headers.
Figure 3:
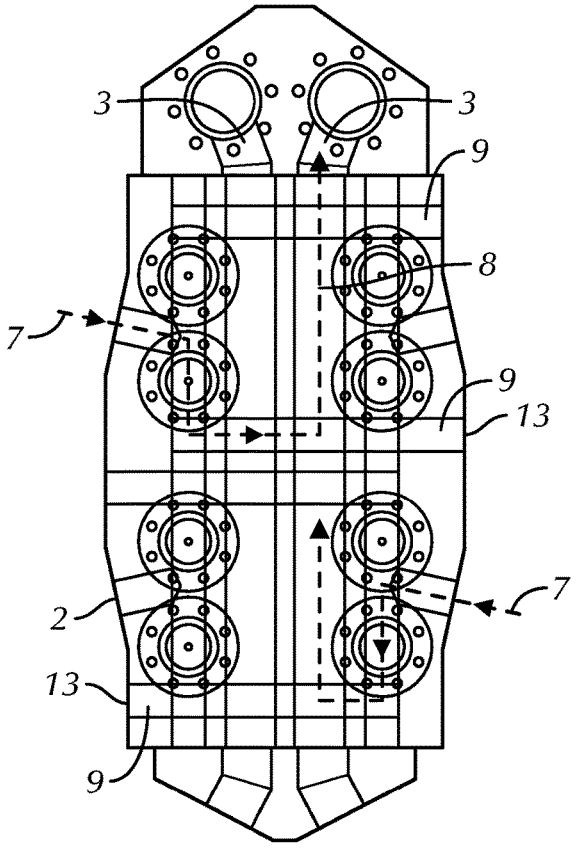
FIG. 3 is another illustrative internal view of one illustrative example of a unique block architecture for a manifold as disclosed herein that is designed for 4 wells, wells flow lines, headers and flow lines in the headers.
Figure 7:
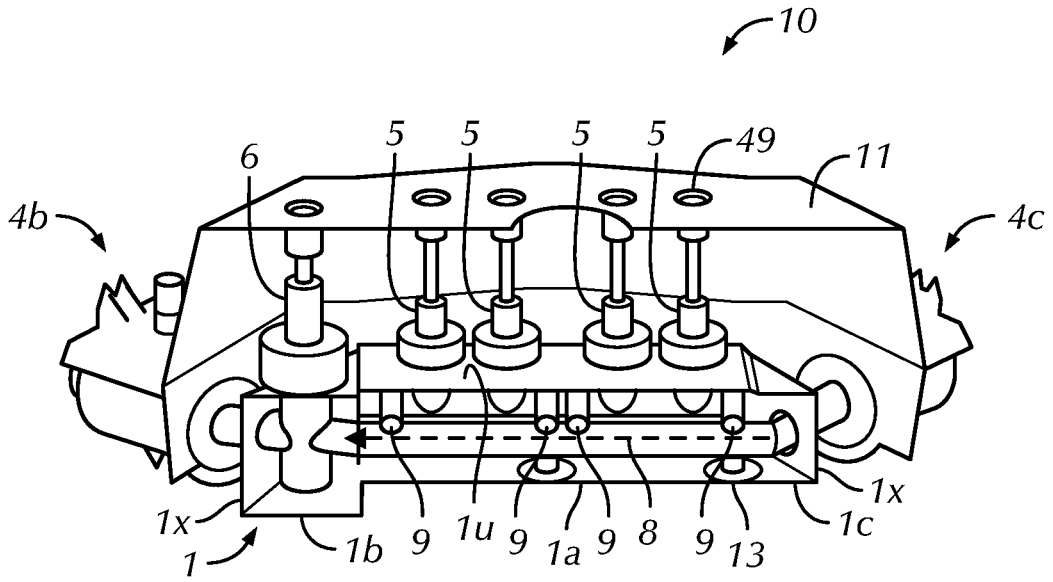
FIG. 7 is a cross-sectional view of one illustrative example of a unique block architecture disclosed herein and flow lines in one of the headers.
Figure 7A:
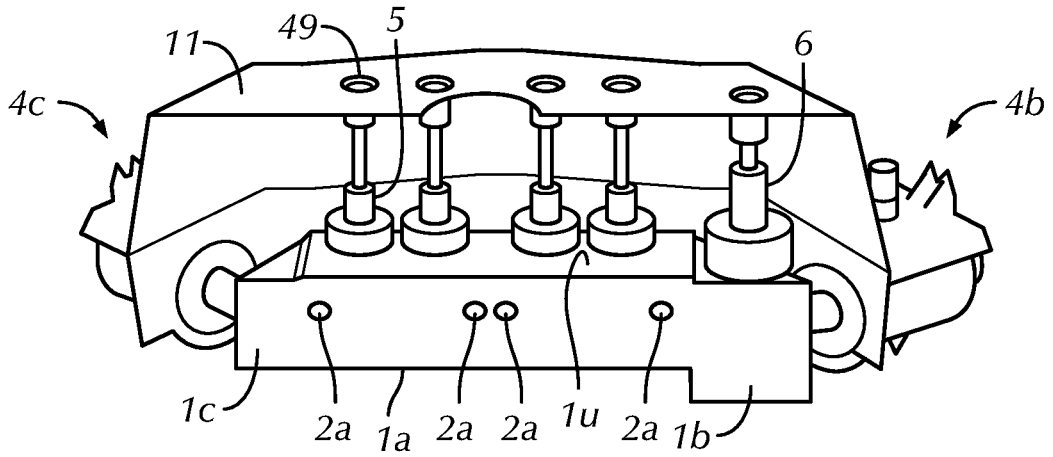
FIG. 7A is another cross-sectional view of one illustrative example of a unique block architecture disclosed herein.

With reference to FIG. 2, in the depicted example, the drilled holes 2 are comprised of an initial portion 2*a*, a portion 2*b* that constitutes an inlet flow sub-header 2*b* and a portion 2*c* that constitutes the intersection 9 (crossover). The inlet flow sub-header portions 2*b* of the holes 2 are positioned approximately parallel to the headers 3. The inlet portion 2*a* of the holes 2 are in fluid communication with the inlet sub-header 2*b*. The well flow isolation valves 5 are positioned in-line in the inlet sub-headers 2*b* so as to direct flow received via the holes 2. The inlet sub-headers 2*b* are also in fluid communication with the intersections 9 (crossovers) and ultimately the headers 3. FIG. 7A is a cross-sectional view taken though the block 1 showing the initial portion 2*a* of the holes 2.

Figure 6:
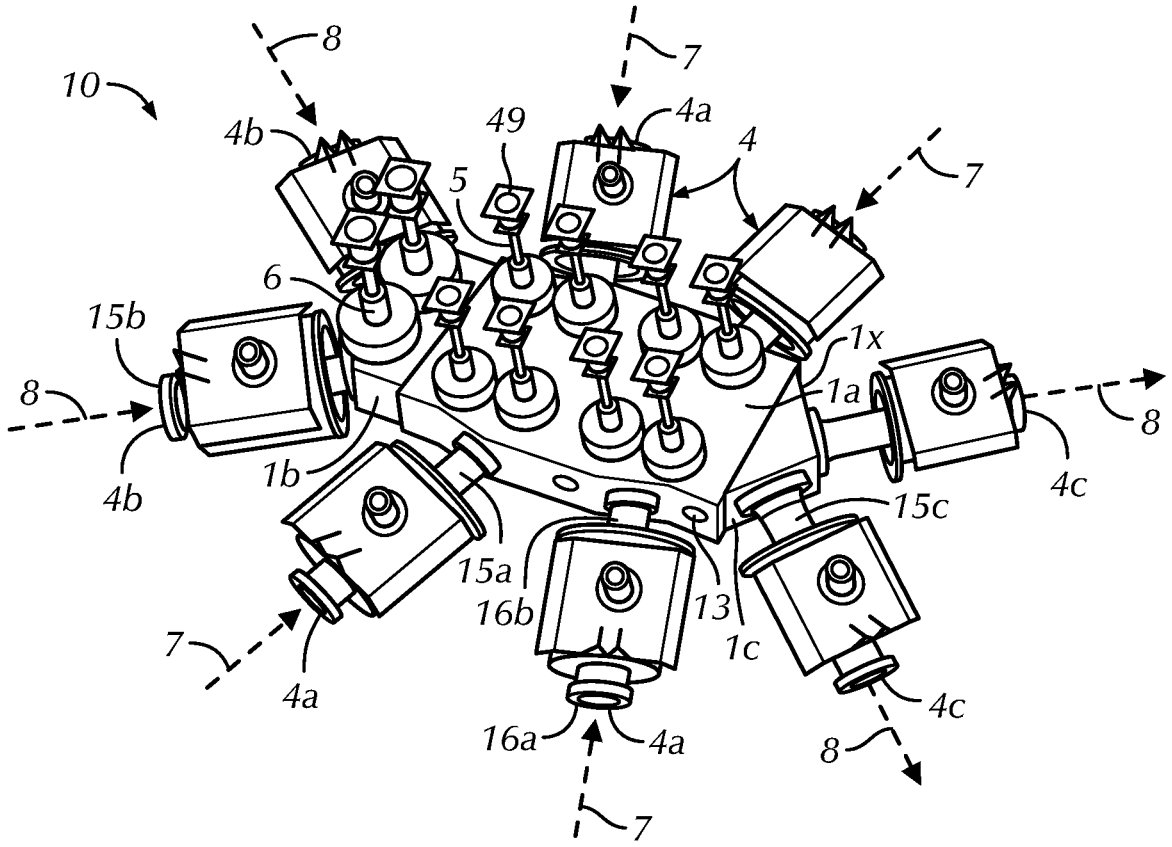
FIGS. 6 and 6A are perspective views showing various aspects of one illustrative embodiment of a manifold system disclosed herein, particularly, a unique block architecture with valves, hubs, and the block for the manifold as described herein.
Figure 7B:
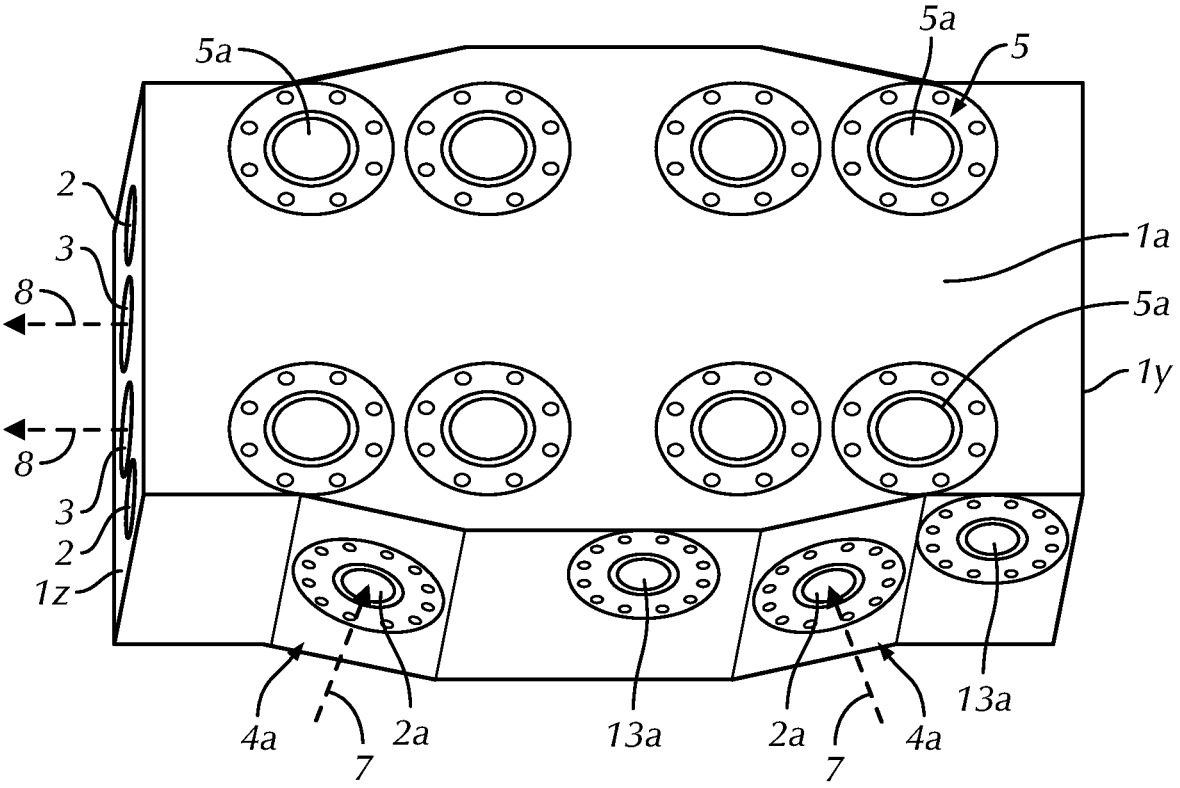
FIG. 7B is a perspective view of one illustrative example of a portion of a unique block architecture disclosed herein.
Figure 7C:
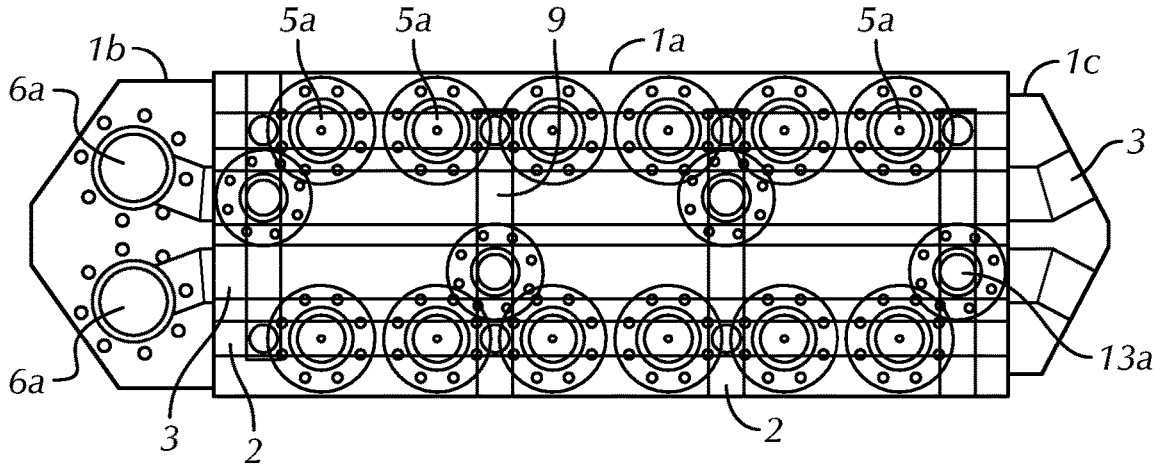
FIG. 7C is a plan view of one illustrative example of a unique block architecture disclosed herein showing various internal drill holes within the block.
Figure 7D:
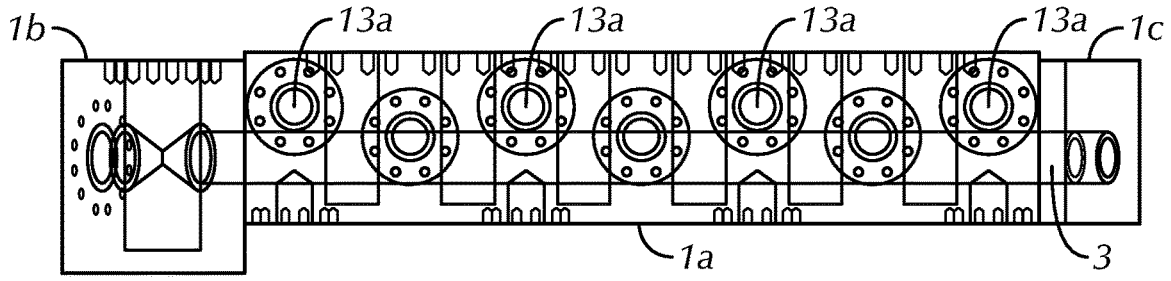
FIG. 7D is a side view of one illustrative example of unique block architecture disclosed herein showing various internal drill holes within the block.
Figure 8:
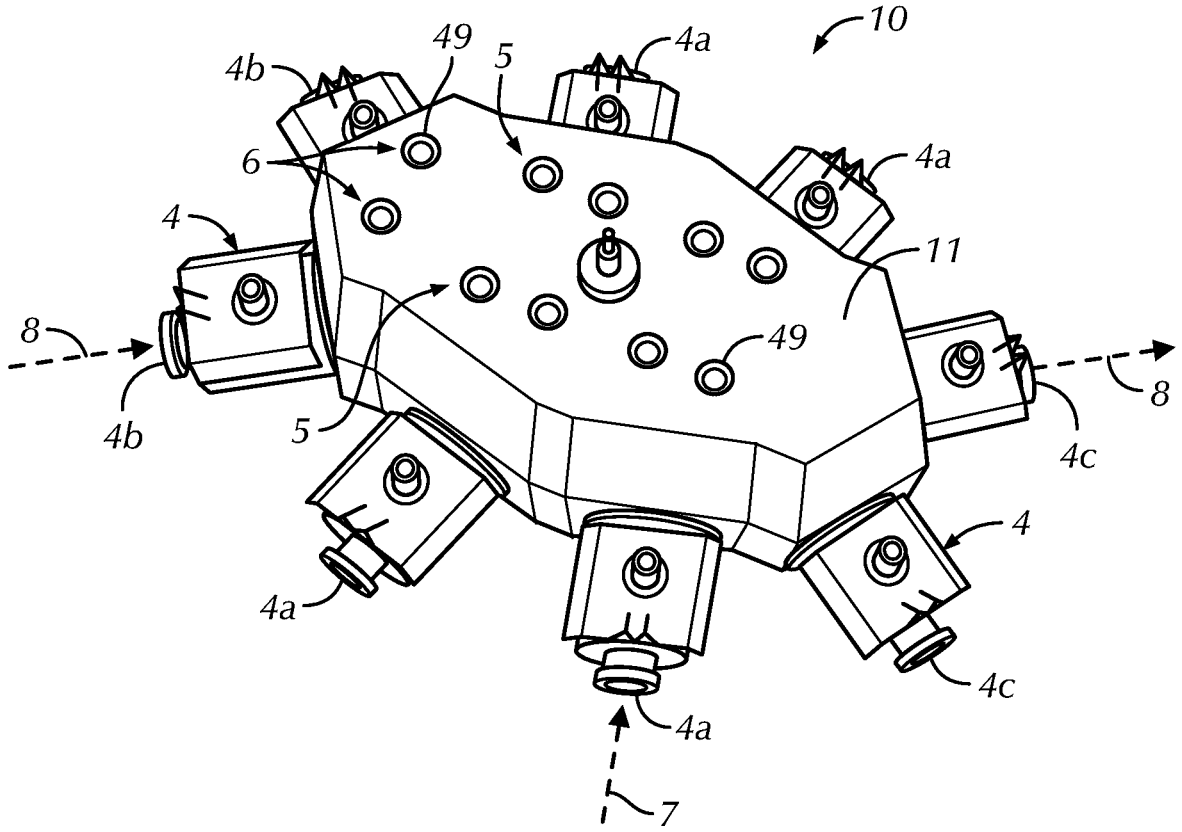
FIG. 8 is another perspective view showing various aspects of one illustrative embodiment of a manifold system disclosed herein.

With reference to FIGS. 5B and 6, the manifold 10 is comprised of four straight in-flow horizontal connector systems 55 that terminate with an outermost hub 55A that is adapted to be coupled to a connector (not shown) on a flow line (not shown) that provides fluid flow into the manifold 10. In the depicted example, each of the in-flow horizontal connector systems 55 is comprised of a spool or conduit 15*a* (see FIG. 6) and a horizontal connector 29 (see FIG. 5B) that is coupled to the spool 15A. Each of the in-flow horizontal connector systems 55 provide a straight, turn-free flow path between the outlet hub of a flow line (not shown) connected to a well to the inlet of a hole 2 in the block 1—the block that houses the isolation valves 5. In the depicted example, four similar horizontal connector systems 55 are provided for the inlet and outlet of the headers 3. More specifically, the header connector systems are comprised of four spools or conduits (15*b*-inlet; 15*c*-outlet) and associated horizontal connectors 29. The header horizontal connector systems provide straight, turn-free flow paths between the hubs of the flow lines (not shown) providing fluid to, and receiving fluid from the headers 3. As shown in FIG. 6, the illustrative spools or conduits 15*a-c* are comprised of an inlet hub 16*a* and an interfacing hub 16*b*. In the depicted example, the inlet hub 16*a* interfaces with a hub of a horizontal connector 29, while the interfacing hub 16*b* is directly coupled to the block 1 (1*a*, 1*b* or 1*c* depending upon the connection at issue) via a flanged/bolted connection. The angled surfaces 1*x* of the end caps 1*b*, 1*c* are provided such that the centerline of the spools or conduits 4*b*, 4*c* may be angled away from one another (or diverge from one another) thereby providing a more compact design of the overall subsea manifold. Of course, in some applications, the end caps 1*b*, 1*c* may be omitted and the spools or conduits 15*b*, 15*c* may be directly coupled to the ends of the generally rectangular shaped body 1*a*.

Figure 6A:
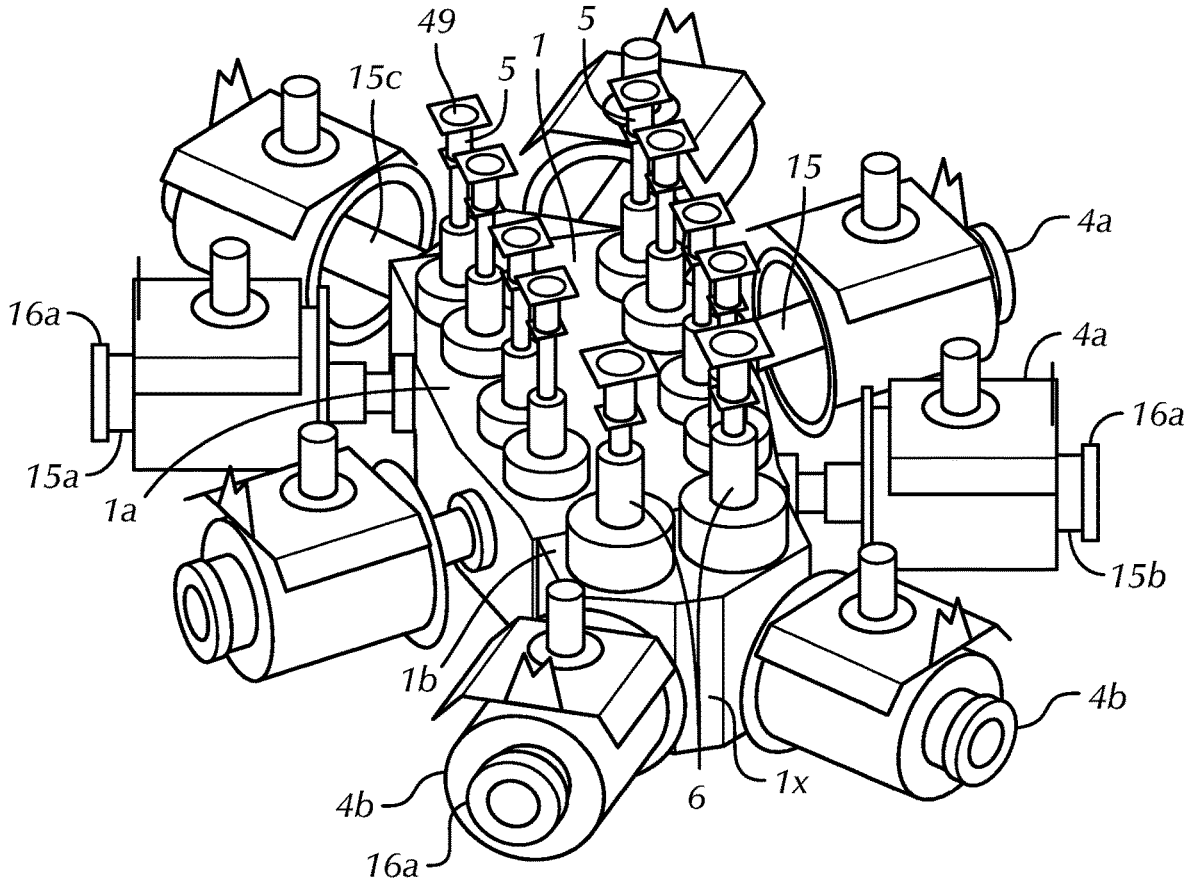

Note that unlike prior art subsea manifolds, using the novel manifold disclosed herein, the horizontal flow path between mating connector of an external flow line. e.g., from a well or other manifold into the holes 2 to the block 1 that contains the isolation valves 5 is a straight, turn-free flow path without any bends. With reference to FIGS. 6 and 6A, one end 16*b* of the horizontal connector systems 55 is coupled to the block 1 while the other end 55A of the horizontal connector systems 55 can be coupled to mating connector on a connecting flow line. That is, unlike prior art designs, the flow path between the outlet of a connecting flow line and the block 1 that houses the isolation valves is a straight opening having a uniform internal diameter and internal flow path with no bends or turns. Such a "straight line" configuration between the hub of the external flow lines and the inlet/outlet to the block 1 facilitates clean out operations and results in a reduction in the overall size and weight of the subsea manifold since piping spools with turns formed therein may be omitted with some embodiments of the presently disclosed manifolds. In the depicted example, the spools or conduits 15*a-c* may be a component that is machined from a forging or it may be a manufactured component that is comprised of a straight section of pipe with welded flanges on opposing ends. In general, providing such straight turn-free flow paths is more desirable in that it is more efficient and avoids problems that may be associated with fluid flow in non-straight flow paths, such as eddy currents, erosion, etc. Moreover, the horizontal connector systems in the depicted example aids in reducing the overall size of the manifold. More specifically, by using the horizontal connector 29, the connection between the outermost hub 55A of the in-flow horizontal connector systems 55 a flow line from a well (and/or other manifolds) can be established remotely. The use of such horizontal connector systems 55 allows lines to be preinstalled (parked) prior to manifold installation. Parking of the flow lines also allows the manifold to be recovered while leaving the flow lines in place. Use of such horizontal connector systems 55 also facilitate a reduction in the amount of structural steel used on the manifold.

As described above, the holes/openings 2, 3 and the intersections 9 (crossovers) are straight constant-diameter holes that are machined (drilled) into the block 1 (1*a*-1*c*). Of course, as noted above, the diameter of the holes 2, 3 and the intersections 9 may be different from one another. These holes are sized so as to provide sufficient diameter for the passage of cleaning devices, such as pigs, through one or more of the flow paths defined in the block 1. Thus, the flow of the fluids originating in production oil wells will readily pass through the holes (2), the intersections (9) and headers (3), i.e., the network of holes within the block 1.

Additionally, using the novel block 1 disclosed herein, substantially all of the piping loads associated with coupling the spools or conduits 15*a-c* to the various flow lines that are coupled to the manifold are absorbed by the block 1. That is, using the novel manifold and block 1 depicted herein, all or significant portions of the arrangement of structural members 20*b* (See FIG. 1*a*) associated with traditional subsea manifolds may be omitted. Such an arrangement provides for significant reductions in the overall size and weight of the novel subsea manifold disclosed herein as compared to traditional subsea manifolds as described in the background section of this application.

Figure 1B:
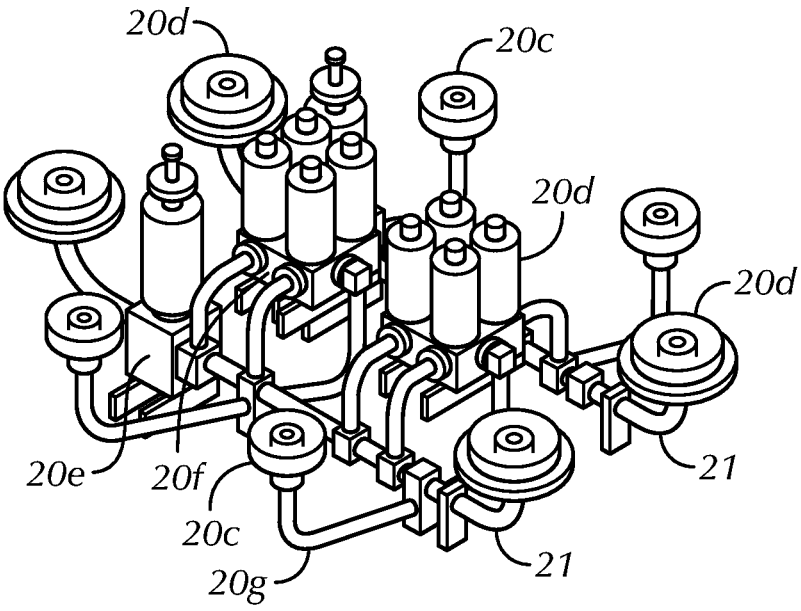
FIG. 1B (Prior Art)

Additionally, relative to the prior art subsea manifold depicted in FIGS. 1*a*-1*b*, the manifold disclosed herein may provide significant reductions in size and weight. For example, relative to the subsea manifold depicted in FIGS. 1*a-b*, the novel manifold depicted in FIG. 6-8 has an overall weight of about 45 tons, e.g., about 50% less than the 90 tons for a comparable prior art subsea manifold described in the background section of this application. More specifically, the weight of the pressure containing components of the novel compact manifold disclosed herein may be about 20 tons (as compared to about 37 tons for the prior art subsea manifold) while the weight of various structural members and the base may be about 25 tons (as compared to about 57 tons for the prior art subsea manifold). Additionally, the novel manifold disclosed herein, including the illustrative shared valve actuator 30, has an overall length of about 5.5 meters, an overall width of about 4 meters and an overall height of about 3 meters. Thus, in this example, the novel manifold disclosed herein has a "footprint" of about 22 $m^2$ on the sea floor and occupies about 66 $m^3$ of space, which is much smaller than the comparable prior art subsea manifold described in the background section of this application.

As will be appreciated by those skilled in the art after a complete reading of the present application, the novel manifold 10 disclosed herein provides several advantages in terms of manufacturing as compared to traditional manifolds, such as those described in the background section of this application. More specifically, the manufacturing process for a traditional manifold involves delivering various components, valves, pipe, fittings, tees, hubs and structural steel, etc., to a fabrication yard where the manifold is fabricated where welding is used as the primary method of joining the components together. Welding is a critical process and requires extensive prequalification of welding processes and welding personnel and inspection methods such as ultrasonic and x-ray inspections. In contrast, the novel manifold disclosed herein eliminates many of these components by drilling various openings in the block of the manifold using proven machining operations that are performed for other equipment, such as subsea Christmas tree blocks. Moreover, the manufacture of the novel manifold disclosed herein may be performed within a controlled manufacturing environment, i.e., a sophisticated machining shop, as opposed to a fabrication yard. Additionally, relative to manufacturing a traditional manifold, manufacturing the novel manifold disclosed herein involves a considerable reduction in welding operations which translates into a reduced reliance on welding, inspection and testing.

In accordance with the drawings, one illustrative example of the shared actuation system (30) disclosed herein comprises a valve actuation tool (39), which may be properly positioned through the movement of a plurality of rotary joints (33, 34, 35) and an arm 60 generally comprised of structural elements (36, 37). The shared valve actuation system 30 is operatively coupled the manifold 10 at a single location such that the arm 60 can rotate about a vertical axis 61 that is normal to an upper surface 1*u* of the block 1, i.e., the arm 60 generally rotates in a substantially horizontal plane around the axis 61. As described more fully below, the shared valve actuation system 30 also comprises various structural members that are coupled to one another by rotary joints.

Figure 10:
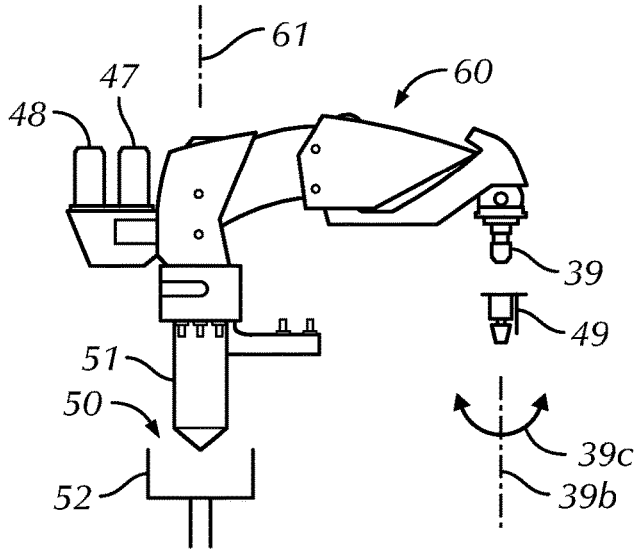
FIG. 10 depicts another view of one illustrative embodiment of anactuation system that may be employed to actuate a variety of valves on a manifold with a manifold described herein.
Figure 11:
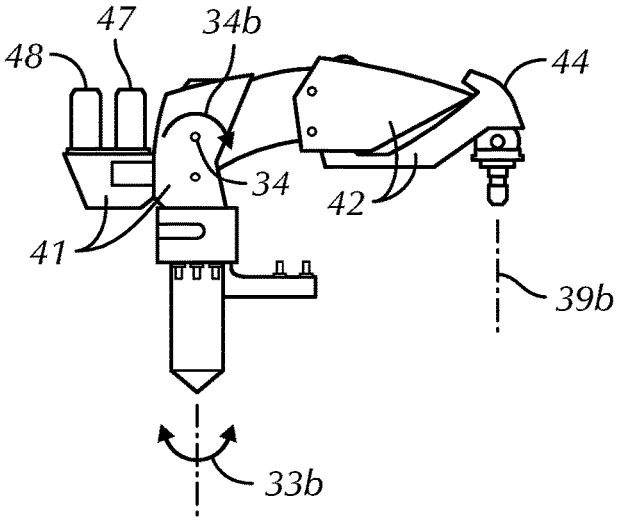
FIG. 11 depicts an example of a weight reduction mechanism that may be part of the shared actuation system described herein.
Figure 12:
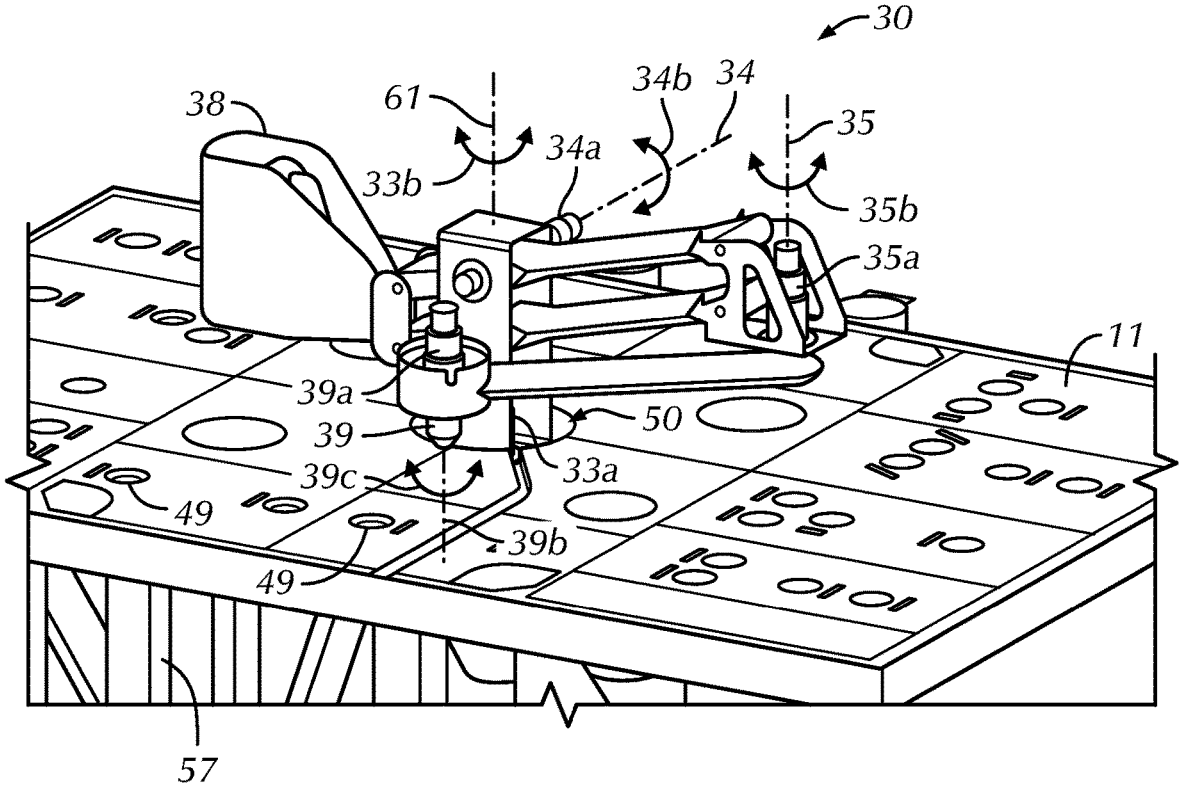
FIGS. 12 and 13 depict illustrative movement of the shared actuation system disclosed herein.
Figure 13:
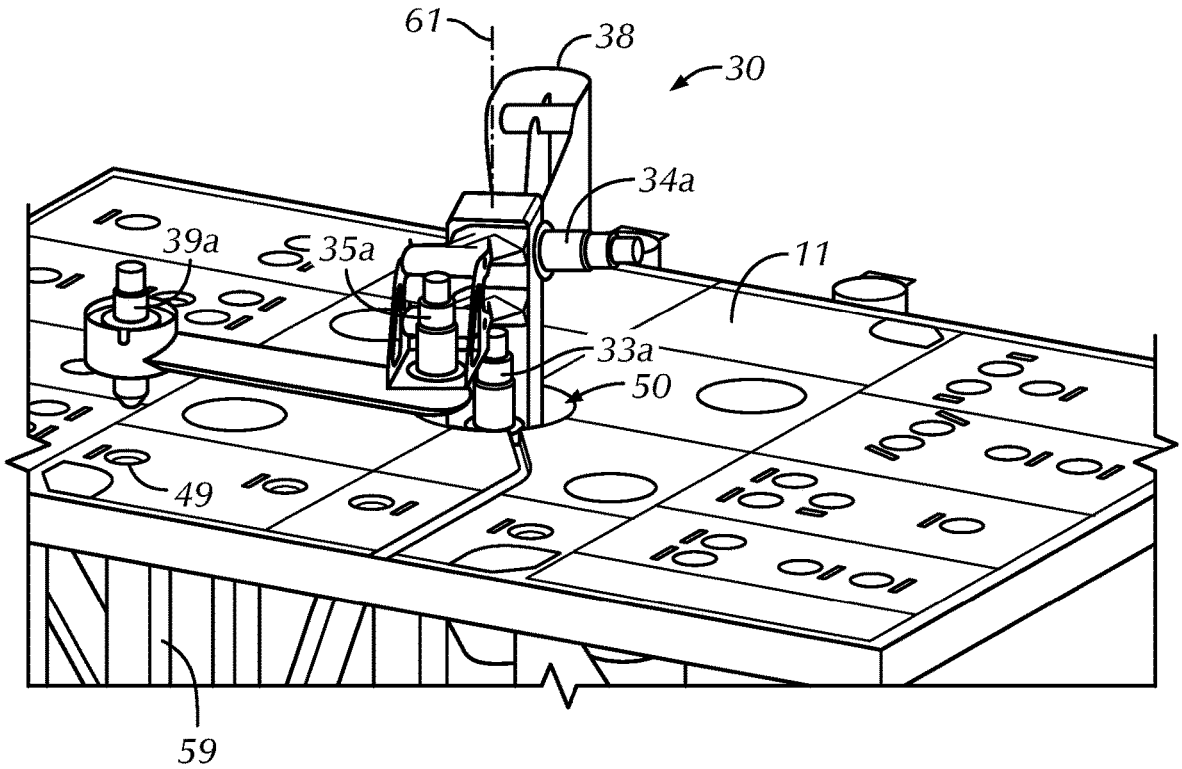

A tool 39 is attached to the end of the arm 60 and it may be actuated so as to actuate one of the valves 5 or 6 in the manifold 10. The structural elements (36, 37) of the arm 60 have a hydrodynamic profile and connect to a sail element (38), which assists in steading and smoothing the movement of the arm 60 in an undersea environment. The hydrodynamic profile was developed to facilitate the movement of the arm 60 in a subsea environment, where the forces induced on the arm 60 during the movement of the arm 60 could be minimized. The sail element (38) is positioned around two units (47, 48) (one on-line and the other one being a spare), each of which contain some of the electronic elements responsible for the autonomous movement of the arm 39. The shared actuation system 30 may be articulated to move the arm 60 as disclosed herein. More specifically, as shown in FIGS. 11-13, the movement of the rotary joints 33, 34, 35 may be independently accomplished by actuating motors 33*a*, 34*a*, 35*a* (which may be electric or hydraulic motors), respectively, so as to cause rotation in directions 33*b*, 34*b*, 35*d* about the axis of rotation of the rotary joints 33, 34 and 35, respectively. The tool 39 may also be rotated as need to actuate (open or close) one of the valves 5, 6 by inserting the tool 39 into a valve stem funnel or guide 49 (see FIGS. 10 and 5A) of one of the valves 5, 6 and thereafter actuating the tool 39 so as to rotate a valve stem (not shown) of one of the valves. The valve stem may be, for example, a threaded valve stem that may be rotated to open or close the valve element of the valves 5, 6. The tool 39 is operatively coupled to an actuating motor 39*a* that is adapted to rotate the tool 39 about an axis 39*b* in either direction 39*c* so as to, in the case of a gate valve, advance the valve stem to close the actuated valve or retract the valve stem so as to open the valve. Importantly, the shared actuation system 30 disclosed herein provides features that allow it to have only one rotary interface 33 which attaches the overall shared actuation system 30 to the manifold 10 unlike the shared actuation systems that rely upon Cartesian coordinates and rails as previously described for the shared actuation systems of the prior art.

The rotary interface 33 between the manifold 10 and the shared actuation system 30 of the present invention is performed through the contact of a single element in the actuation system 30 and a single element in the manifold 10. In one example, with reference to FIGS. 10, 12, 5A and 5B, the single element in the actuation system 30 consists of a pin (51) and the single element in the manifold 10 constitutes a funnel or guide (52). In the depicted example, the pin 51 is mechanically secured to the funnel or guide 52 such that the interface between the pin 51 and the guide 52 defines a rigid interface that provides a reaction point against the forces exerted by the movement of the arm 60. The funnel or guide 52 may be supported by various structural members (not shown) that are coupled to the block 1. The system may also be provided with a cable management system to control the cables/lines (electrical or hydraulic or battery powered) that are used when actuating motors 33*a*, 34*a*, 35*a*, e.g., a spool containing the cables/lines that may be "fed-out" or retracted as needed as the arm 60 is moved to actuate various valves.

Due to the rotary interface 33, the tool 39 may be rotated about 360 degrees around the funnel or guide 52. The rotary interface feature 33 provides an advantage by allowing the attachment of the shared actuation system 30 to the manifold 10 after or near the completion of the assembly of the manifold 10. Moreover, the rotary interface 33 feature and the associated pin/guide interface also enhance interchangeability between systems and manifolds. The rotary interface 33 feature and the associated pin/guide interface are also important in manufacturing situations in terms of scale and facilitating the ability to replace defective units. The manifold is usually designed to be used in deep water (e.g. 1000-2000 m) for many years (e.g. 25 years), and the maintenance and installation of this equipment has to be done remotely so it is desirable to have a simpler connection so as to facilitate the installation and removal of the shared actuation system 30 as needed.

Furthermore, the straightforward rotary interface 33 and the associated pin/guide interface between the shared actuation system 30 and the manifold 10 provides significant advantages during the replacement operation of the system at the seabed by remotely operated vehicles (ROVs). This advantage is due to the use of the single interface rotary connection 33, rather than multiple interfaces with the manifold, thereby allowing easy installation and removal of the shared actuation system 30. Additionally, to facilitate replacement operations, the structural elements (36, 37) of the system may be constructed of lightweight composite material (41), and filled with floating elements (42) so that the submerged weight of the unit is on average less than 100 kg, with this weight being the acceptable limit by most ROV operators to lift with handlers operated by electric or hydraulic motors.

Figure 9:
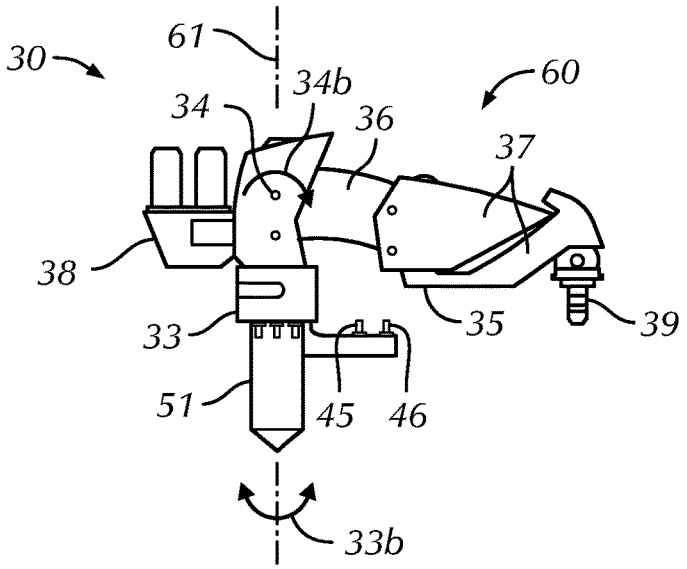
FIG. 9 depicts one illustrative embodiment of a shared actuation system that may be employed to actuate a variety of valves on a manifold as described herein.

FIG. 9 depicts two electrical connectors (45, 46) for an ROV to be able to connect jumpers to the subsea lines, one for the power unit and the other for the communication to a top-side unit.

Other advantages of the actuation system 30 disclosed herein relative to prior art Cartesian coordinate based systems described in the background section of this application are related to the protection of the mechanisms responsible for the movement of the tool 39 from harsh effects of the environment, e.g., corrosion, growth of lime and magnesium deposits due to cathode protection systems and growth of marine life. In the shared actuation system 30 disclosed herein, the positioning of the tool 39 in the desired location (e.g., above a valve that is to be actuated) is performed by means of actuating motorized rotary joints (rotary joints 33, 34, 35) so as to cause movement of the structural elements (36, 37), which transform the rotary movement of the joints into the desired movement and positioning of the end of the arm 60 where the operating tool 39 is positioned. Thus, all components that are used to cause movement of shared actuation system 30 disclosed herein have sliding moving parts that are contained in rotary joints. The mechanisms or elements of the rotary joints are sealed from exposure to the external environment and they are further protected by lubricating oil so as to protect the mechanisms or elements from possible adverse effects from the environment, as described above. Note that this protection from the environment is not possible or practical when using the relatively long sliding mechanisms (e.g., rails) commonly found on prior art Cartesian coordinate based shared actuation systems as the required rails, that are used to position a valve actuator in the desired location, are typically exposed to seawater.

The strategy of using rotary joints for conducting the translational movements can be observed both for achieving the horizontal movement and for achieving the vertical movement of the tool 39, through the use of a four-bar mechanism.

Another advantage presented by the shared actuation system 30 disclosed herein consists of the minimization of the energy needed for the movement of the components of the arm 60 and ultimately the tool 39. The reduction is a consequence of the hydrodynamic geometry in the structural elements (36, 37) of the system and the use of a structure with sail 38 opposite to the structural elements (36, 37) so that the moment imposed by marine currents acting on the system is neutralized. For example, a dedicated robot (in the form of the depicted shared valve actuation system 30) could be provided on the manifold 10 while another dedicated robot could be added to a Christmas tree or PLET or PLEM. The structural steel 57 and cover 11 shown in FIGS. 12 and 13 is intended to show that the arm 60 may be used in the novel manifold 10 and/or on a separate structure (without the cover 60).

In this sense, the shared actuator system 30 disclosed herein may also be advantageously applied to the execution of other tasks in addition to the operation of the valves 5, 6 in the manifold 10. That is, by the inclusion of appropriate tools that may be attached to or replace the tool 39 other operations may be performed with the actuator system 30 disclosed herein, e.g., tools associated with as leak detection systems, cameras, sensor readers, transducers, among others, may be attached to or replace the tool 39. Additionally, the shared actuation system 30 can be expanded to perform tasks on other undersea equipment such as Christmas trees, Pipeline End Module (PLEM), Pipeline End Termination (PLET) and others. Accordingly such undersea equipment may include one or more shared actuation systems 30 disclosed herein.

In one illustrative example, the shared actuation system 30 disclosed herein is adapted for use in positioning the tool 39 on any valve interface submerged on an oil production station located in subsea structure. In general, the shared actuation system 30 comprises an actuation tool 39 which may be positioned by the actuation of the rotary joints (33, 34, 35) and structural elements (36, 37) which have a hydrodynamic profile and connect to a sail element 38 suitable for movement in the undersea environment.

In one particular example, the actuation tool 39 disclosed herein is adapted for interaction with valve interfaces and may for instance be a rotary tool for opening and closing of valves, e.g., the isolation valves 5, 6 disclosed above. The actuation tool 39 may be positioned at a distal part of an assembly of structural elements (36, 37), in the form of arms, connected to each other by rotary joints 33, 34, 35. The degree of freedom for the part with the tool 39 is thereby dependent on the number of arms and joints and the type of joints in the assembly. The structural elements (36, 37), or at least one of the structural elements have a hydrodynamic profile in that when it is moved through water, the forward edge of the element moving facing the water when moved through water has a relative thinner cross section compared with the trailing part of the same structural element. As one longitudinal structural element may normally be operated in one plane relative the structural element it is attached to, rotating around one axis in the rotary joint which is perpendicular to the longitudinal direction of the structural element, the structural element may be formed with a relative thinner cross section at two forward edges opposite each other compared with the trailing part of the structural element in the movement directions. The distal structural element may in one configuration together with the additional other structural elements and the joints, be arranged to be rotational about two parallel axis and possibly also one axis perpendicular to these two axis. These are just examples or possible degrees of freedom of the different elements and how they then may be made with a hydrodynamic profile. The sail element 38 may be connected to the assembly of structural elements and joints, in an opposite position compared with the actuation tool. The sail element 38 has one function of providing stability to the assembly of structural elements and joints, as this is rotated and extended to interact with different valve interfaces. The sail element 38 holds two units 47, 48 (one on-line and the other one spare) which contain the electronic elements as the robotic motion unit and the robotic drive unit responsible for the autonomous movement of the arm.

As mentioned above, the shared actuation system 30 may comprise a single rotary interface 33 with the subsea equipment (e.g. a manifold 10) based upon the interface between a single element on the actuation system 30 and a single element in the equipment. In one illustrative embodiment, the element in the actuation system 30 is a pin 51 and the element in the manifold is a funnel 52. It is also possible to have different single interfaces, or to have the funnel 52 and pin 51 arranged on the opposite parts of the actuation system 30 and the equipment, respectively.

According to another aspect there is provided a shared actuation system 30 for positioning a tool 39 relative to several valve interfaces on a subsea structure as a manifold. During normal operation, the shared actuation system 30 is attached to the subsea structure. It may be arranged to be separately retrievable from the subsea structure and may have retrieving means (not shown) in for instance an attachment device for an ROV or line deployed from vessel. Attached to the connection device there is at least one structural element, possibly two, three or four structural elements, all connected to each other through rotary joints, providing at least two degrees of freedom for a distal end of the structure elements where an actuation tool 39 is positioned. The assembly of structural elements and rotary joints may for instance provide three degrees of freedom for the distal end of the assembly. The tool 39 is positioned for interaction with the valve interfaces or other equipment on the subsea structure. The structural elements are further connected to a sail element 38. The sail element 38 is designed to hold the robotic motion and drive units responsible to control the movements of the robotic arm and compensate the weight. The structural elements assembled may be of different kinds and or some may be similar. In one possible embodiment the structural elements may be a post rotating around its own axis, a joining element arranged pivoting relative to the post about an axis perpendicular to the rotation axis of the post, and an arm element attached to the joining element forming a distal element in the assembly. The arm element may also be rotational attached to the joining element with a rotation axis mainly parallel with the rotation axis of the post.

According to another aspect the actuation system 30 disclosed herein comprises a control system arranged to operate the arm 60. The operation consists on moving the rotary joints to position the tool 39 relative the desired valve interface for interaction with a particular valve. The control system may be provided integral with the actuation system 30 or it may be attached to the structural elements (36, 37) of the system. The actuation system 30 operates in an autonomous way, knowing the movements necessary to reach the desired position for the tool 39. In the depicted example, the control system is positioned within f the sail element 38, which holds the electronic systems necessary to operate the actuation system 30. The electronic system is comprised of a robotic drive unit and a robotic motion unit. The robotic motion unit has an electronic motion controller board, system power supply boards, with line couplers and memories. The robotic drive unit has the motor drive and power supply. The control system may also comprise a communication unit for communication with a remote located operator. Such communication may be accomplished using hard-wired or wireless communication tools and techniques. The rotary joints are operated by signals coming from the electronic unit and a remote signal from a control unit arranged on the subsea structure or a transmitter or communication unit arranged on the subsea structure receiving operating signals from a remote operator.

According to another aspect of the subject matter disclosed herein there is also provided a subsea system, comprising a subsea structure and a shared actuation system 30 according to what is explained above where the shared actuation system 30 is connected to the subsea structure in one fixed position. Moreover, in this example, there is at least two structural elements (36, 37) connected by a rotary joint, arranged such that the tool 39 at the distal end of the structural elements (36, 37) or arm 60 may be operated to interact with several valve interfaces arranged around this fixed position and at different radial distances from the fixed position.

In another example, the actuation system 30 may be, in effect, an independent actuation system that may be positioned on the sea floor, without being connected to a surface umbilical. In such an embodiment, the actuation system 30 may be operatively coupled to a moveable device, such as and ROV (that is not coupled to the surface by umbilicals) or it may be mounted to a subsea structure such that the actuation system 30 may be used to perform any of a number of operations on a variety of items of subsea equipment, e.g., trees, flowlines, manifolds, etc. In this particular embodiment, a plurality of tools (not shown) for performing a variety of different services may be located or positioned at or near a subsea "home" for the actuation system 30, and they may be accessed as needed by the actuation system 30 so as to enable it to perform its intended function on such subsea equipment.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

The invention claimed is:

1. A system for receiving fluid flow from a plurality of external flow lines, each of the external flow lines being connected to a respective one of a plurality of sources of fluid to be provided to the system, the system comprising:
   - a manifold comprising:
   - a block;
   - at least one drilled header hole formed within the block;
   - a plurality of drilled flow inlet holes formed within the block, wherein the number of drilled flow inlet holes corresponds to a number of the plurality of external flow lines, the drilled flow inlet holes being in fluid communication with the at least one header hole via at least one other drilled hole formed within in the block;
   - a plurality of isolation valves coupled to the block wherein a valve element of each of the isolation valves is positioned within the block; and
   - a shared valve actuation system that is operatively coupled to the manifold at a single location, the shared valve actuation system comprising:
     - an arm that is adapted to rotate about an axis that is normal to an upper surface of the block;
     - the arm comprising a plurality of structural elements that are coupled to one another via rotary joints; and
     - a tool coupled to a distal end of the arm, the tool adapted to engage and actuate one of the plurality of isolation valves.

2. The system of claim 1, wherein each of the rotary joints is coupled to an actuating motor.

3. The system of claim 2, wherein each of the actuating motors is one of an electric or hydraulic motor.

4. The system of claim 1, wherein the shared valve actuation system is operatively coupled to the manifold by a pin and a guide funnel that is adapted to receive the pin.

5. The system of claim 4, wherein the pin is part of the arm and the guide funnel is coupled to the block.

6. The system of claim 1, wherein the rotary joints are sealed from an external environment.

7. The system of claim 1, further comprising a control system to position the tool relative to a desired location for actuating one of the plurality of isolation valves.

8. The system of claim 2, further comprising a control system to actuate each of the motors coupled to the rotary joints.

9. The system of claim 1, wherein the manifold comprises at least two drilled header holes, at least four drilled flow inlet holes and wherein the plurality of isolation valves comprises two header isolation valves, each of which is positioned in one of the two drilled header holes, and eight flow isolation valves, wherein, for each drilled flow inlet hole, two of the eight flow isolation valves are coupled to the block so as to direct fluid flow received into the drilled flow inlet hole to at least one of the two drilled header holes.

10. The system of claim 1, wherein the block is comprised of a body portion, an inlet cap portion and an outlet cap portion.

11. The system of claim 10, wherein the plurality of isolation valves comprises a header isolation valve coupled to the inlet cap portion of the block and a plurality of flow isolation valves coupled to the body portion of the block so as to direct fluid flow received into the drilled flow inlet holes to the at least one header hole.

12. The system of claim 1, wherein the block is a single block of material with the least one drilled header hole and the plurality of drilled flow inlet holes formed within the single block of material.

13. The system of claim 1, further comprising a plurality of horizontal connector systems, each of which defines a straight, turn-free internal flow path within the horizontal connector system, each horizontal connector system having a first end that is couple to the block and in fluid communication with one of the drilled flow inlet holes and a second end that has a hub that is adapted to be coupled to an outlet hub of a single one of the external flow lines.

14. The system of claim 1, wherein the at least one header hole has a first diameter and each of the drilled flow inlet holes has a second diameter, the first diameter being greater than the second diameter.

15. The system of claim 1, wherein the at least one header hole has a first diameter and each of the drilled flow inlet holes has a second diameter, wherein the first diameter and the second diameter are equal.

16. The system of claim 1, wherein the sources of fluid to be provided to the system comprise a plurality or oil/gas wells or another manifold.

17. The system of claim 1, wherein the isolation valves are gate valves.

18. The system of claim 1, wherein the at least one header hole comprises at least two header holes.

* * * * *